United States Patent [19]

Horiguchi et al.

[11] Patent Number: 4,997,406

[45] Date of Patent: Mar. 5, 1991

[54] COIN REMOVING APPARATUS FOR COIN HANDLING MACHINE

[75] Inventors: Nobushige Horiguchi, Kitamoto; Hideki Kimura, Matsudo, both of Japan

[73] Assignee: Laurel Bank Machines Co., Ltd., Tokyo, Japan

[21] Appl. No.: 424,199

[22] Filed: Oct. 19, 1989

[30] Foreign Application Priority Data

Oct. 19, 1988 [JP] Japan ..... 63-136235[U]
Sep. 27, 1989 [JP] Japan ..... 1-251362

[51] Int. Cl.[5] ..... G07D 1/00; G07D 3/14
[52] U.S. Cl. ..... 453/57; 453/7
[58] Field of Search ..... 453/5, 6, 7, 9, 11, 453/57; 194/344, 346

[56] References Cited

U.S. PATENT DOCUMENTS

| | | | |
|---|---|---|---|
| 3,795,253 | 3/1974 | Hatanaka et al. | 453/57 |
| 3,861,408 | 1/1975 | Hatanaka et al. | 453/57 |
| 4,167,949 | 9/1979 | Hashimoto et al. | 453/57 X |
| 4,173,232 | 11/1979 | Asami et al. | 453/57 |
| 4,460,004 | 7/1984 | Furuya | 194/317 X |
| 4,758,201 | 7/1988 | Ozeki | 453/56 |
| 4,772,244 | 9/1988 | Ozeki | 453/57 |
| 4,800,997 | 1/1989 | Ozeki et al. | 194/344 |
| 4,861,312 | 8/1989 | Sentoku | 453/7 |
| 4,904,223 | 2/1990 | Sentoku | 453/7 |

FOREIGN PATENT DOCUMENTS

| | | | |
|---|---|---|---|
| 3021327 | 12/1981 | Fed. Rep. of Germany | 453/57 |
| 3724994 | 2/1988 | Fed. Rep. of Germany | 453/7 |
| 3833915 | 4/1989 | Fed. Rep. of Germany | 453/7 |
| 58-92084 | 6/1983 | Japan . | |
| 1559741 | 1/1980 | United Kingdom . | |
| 1585298 | 2/1981 | United Kingdom . | |

*Primary Examiner*—Frank E. Werner
*Assistant Examiner*—Scott L. Lowe
*Attorney, Agent, or Firm*—Fleit, Jacobson, Cohn, Price, Holman & Stern

[57] ABSTRACT

A coin removing apparatus for a coin handling machine of a rotatable disk type including a coin jamming eliminator for conducting unjamming operation by rotating the rotatable disk and driving a coin transporting belt in a reverse direction and then rotating the rotatable disk and driving the coin transporting belt in a normal direction, and repeating such operation a predetermined number of times in a case where a coin detector detects coins on the rotatable disk after a predetermined time has passed since a sensor detected a last coin, the coin removing apparatus including a coin removing lever for removing the coins on the rotatable disk and a controller for driving the coin removing lever to remove the coins from the rotatable disk, in the case where the sensor does not detect any coins and the coin detector detects some coins after a predetermined time has passed since the unjamming operation was completed. In this coin removing apparatus, coins remaining in the coin handling machine can be easily removed.

3 Claims, 3 Drawing Sheets

COIN REMOVING APPARATUS FOR COIN HANDLING MACHINE

CROSS REFERENCE OF RELATED APPLICATIONS

The present invention relates generally to the subject matter of the following prior U.S. patents applications: Ser. No. 07/170,379, filed on Mar. 18, 1988, entitled "Coin Handling Machine," now U.S. Pat. No. 4,861,312 and Ser. No. 07/253,610, filed on May 10, 1988, entitled "Coin Sorting Apparatus," now U.S. Pat. No. 4,904,223.

BACKGROUND OF THE INVENTION

The present invention relates to a coin removing apparatus for a coin handling machine having a coin sorting means for sorting coins in accordance with their denominations, and, more particularly, to such an apparatus for the coin handling machine capable of removing jammed coins in the coin handling machine without fail.

DESCRIPTION OF THE PRIOR ART

There is known a coin handling machine which is constituted so that coins deposited through a coin deposit opening are fed onto a rotatable disk provided with a annular guide on the periphery thereof to be fed one by one to a coin sorting means through an opening formed in the annular guide, while being guided by the inner face of the annular guide, and their value is counted by a sensor provided for the coin sorting means and they are sorted in accordance with their denominations, while being transported by a coin transporting means provided for the coin sorting means, and are further wrapped in accordance with their denominations, if necessary.

For example, Japanese Patent Publication No. 62-59834 proposes such a kind of coin handling machine. In this machine, a double feed preventing means is provided between the opening formed in the annular guide and the coin sorting means for feeding the deposited coins one by one from the disk to the coin sorting means, the space between the double feed preventing means and the upper face of a coin passage being set so as to be slightly greater than the thickness of the thickest coins to be handled, and the coin sorting means comprises a fixed guide plate, a movable guide plate and a coin collecting opening which opens below the fixed guide plate and the movable guide plate. The space between the fixed guide plate and the movable guide plate is adjusted so that the largest diameter coins to be handled can be transported between the fixed guide plate and the movable guide plate by the coin transporting means, while all coins of smaller diameter than that of the largest diameter coins to be handled fall into the coin collecting opening, whereby the coins of the denomination having the largest diameter can be sorted from the coins of the other denominations. In this coin handling machine, there is further provided a coin detection lever swingable about a horizontal shaft in the vicinity of the inner face of the annular guide so that the space between its tip end and the upper face of the disk is slightly greater than the thickness of thickest coins to be handled.

In this coin handling machine, when the coin detection lever detects that some coins remain on the disk, even after a predetermined time has passed since the sensor detected the last coin, it is judged that jamming of coins has occurred and an attempt is made to unjam the coin jammed by rotating the disk and moving the coin transporting means in the reverse direction and further rotating the disk and moving the coin transporting means in a normal direction again, and, if necessary, repeating such operation. However, if the coin jamming cannot be eliminated by conducting such operation, the jammed coins in the machine are removed by opening the coin handling machine.

However, in the thus constituted coin handling machine, it is very difficult to unjam the coins without fail and, further, there is some risk that the coin handling operation will be concluded because it is judged that the coin handling operation has been completed, even though some coins still remain in the coin handling machine.

More specifically, in cases where coins other than those to be handled are erroneously deposited into the coin handling machine for some reason, if the erroneously deposited coins have thickness greater than that of the thickest coins to be handled and the space between the double feed preventing means and the upper face of the coin passage, the coins are prevented from feeding from the disk to the coin sorting means by the double feed preventing means, whereby they inevitably remain on the disk, and if the erroneously deposited coins have a larger diameter than that of the largest diameter coins to be handled, since they cannot pass through the portion between the fixed guide plate and the movable guide plate, they are prevented from being fed to the coin sorting means by these plates and are returned onto the disk by the rotational force of the disk. These coins are never fed to the coin sorting means, even if the above described unjamming operation is repeated and it is impossible to unjam the coins. Nevertheless, in cases where the thickness of the erroneously deposited coins is greater than that of the thickest coins to be handled but smaller than the space between the tip end of the coin detection lever and the upper face of the disk, or where the diameter of the erroneously deposited coins is larger than that of the largest diameter coins to be handled and the thickness thereof is smaller than the space between the tip end of the coin detection lever and the upper face of the disk, since the coin detection lever cannot detect any remaining coins, it is erroneously judged that the coin handling operation has been completed when a predetermined time has passed after the sensor detected the last coin, whereby there is some risk of the coin handling operation being concluded, even though some coins still remain on the disk.

SUMMARY OF THE INVENTION

It is, therefore, an object of the present invention to provide a coin removing apparatus for a coin handling machine capable of removing jammed coins without fail.

According to the present invention, the above and other objects can be accomplished by a coin removing apparatus for a coin handling machine comprising a rotatable disk for receiving deposited coins, annular guide means provided on the periphery of said rotatable disk and formed with an opening, coin sorting means for sorting the coins in accordance with their denominations, double feed preventing means disposed above a coin passage between said coin sorting means and said opening of the annular guide means, a space between said double feed preventing means and said coin passage being adjustable, coin transporting means provided in said coin sorting means for transporting the coins, sensor means provided in said coin sorting means for detecting the coins, coin detection means for detecting presence of coins on said rotatable disk and coin jamming eliminating means for conducting unjamming operation by rotating said rotatable disk and driving said coin transporting means in the reverse direction and then rotating said rotatable disk and driving said coin transporting means in the normal direction, and repeating such operation a predetermined number of times in a case where said coin detection means detects coins on said rotatable disk after a predetermined time has passed since said sensor means detected the last coin, said coin removing apparatus comprising coin removing means for removing the coins on said rotatable disk and control means for driving said coin removing means to remove the coins from said rotatable disk, in the case where said sensor means does not detect any coins and said coin detection means detects some coins after a predetermined time has passed since the unjamming operation was completed.

In a preferred aspect of the present invention, said coin removing means comprises a lever which is swingable about a shaft and projects onto said rotatable disk when said coin removing means is driven by said control means, a side face of said lever being formed arcuately so that it has the same shape as the circumference of said rotatable disk, and when said coin removing means is driven by said control means, said lever swings in an opposite direction to that of rotation of the rotatable disk so that said side face of the lever can catch the coins remaining on said rotatable disk and remove them.

DESCRIPTION OF THE PREFERRED EMBODIMENTS

Figure 1:
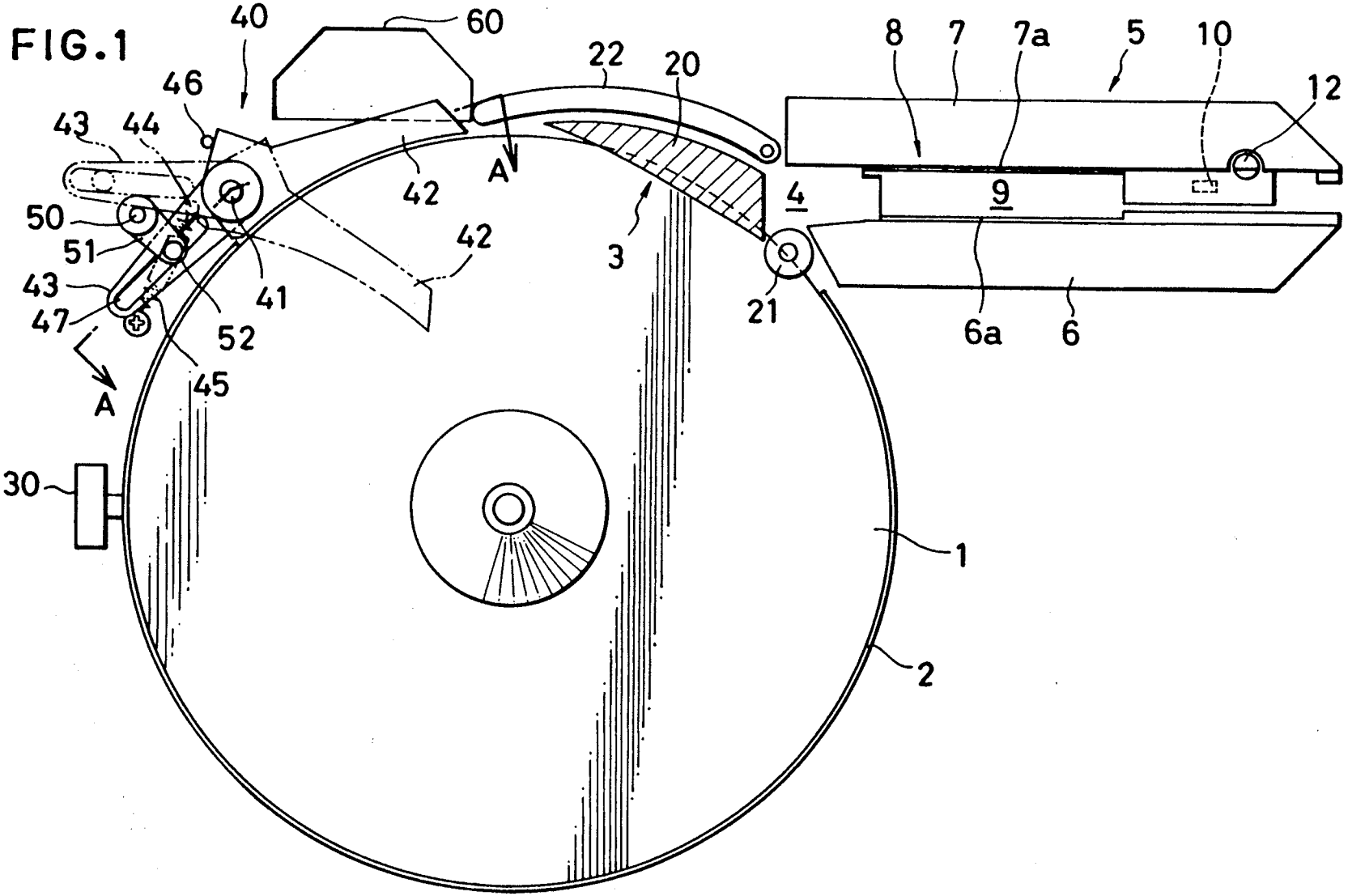
FIG. 1 is a schematic drawing showing a plan view of a coin handling machine including a coin removing apparatus which is an embodiment of the present invention.

Referring to FIG. 1, a coin removing apparatus for a coin handling machine which is an embodiment of the present invention is provided a rotatable disk 1 for receiving coins deposited through a coin deposit opening (not shown) from a coin feed belt (not shown) onto the upper face thereof and an annular guide 2 disposed along a circumference of the rotatable disk 1 and a part of the annular guide is formed with an opening 3. Downstream of the opening 3 of the annular guide 2, a coin sorting apparatus 5 is connected via a coin passage 4 for sorting the coins in accordance with their denominations.

In the coin sorting apparatus 5, there are provided a pair of guide plates 6, 7, the space therebetween being adjustable and guide rails 6a, 7a are secured to the bottom faces of the pair of guide plates 6, 7 respectively, whereby a coin sorting passage 8 is formed between the pair of guide plates 6, 7. Below the pair of guide plates 6, 7, a coin collecting opening 9 is formed and coins of smaller diameter than the space between the guide rails 6a, 7a fall into the coin collecting opening 9 and are collected by a collecting means (not shown). The space between the pair of guide plates 6, 7 is set by a first space adjusting means (not shown) to be larger than the largest diameter of coins to be handled so as to enable feeding of all coins deposited into the coin handling machine into the coin sorting passage 8 and so that only the largest diameter coins to be handled can be transported in the coin sorting passage 8, with the edges thereof being supported by the guide rails 6a, 7a, and coins of the other denominations fall into the coin collecting opening 9. Further, above the coin sorting passage 8, there is provided a transporting belt (not shown) engaged with pulleys (not shown) for transporting the coins fed from the rotatable disk 1 via the opening 3 of the annular guide 2 and the coin passage 4 in the coin sorting passage 8. In the coin sorting passage 8 downstream of the coin collecting opening 9, a sensor 10 is provided for discriminating the genuineness of the coins passing thereon and counting the number of the coins and detection signals are input to a control system (not shown).

Further, a rotatable stopper 12 is provided in the coin sorting passage 8 downstream of the sensor 10 and although not shown, downstream of the coin sorting passage 8, there are provided a coin stacking section for stacking a predetermined number of coins and a coin wrapping section for wrapping the coins stacked by the coin stacking section.

Figure 2:
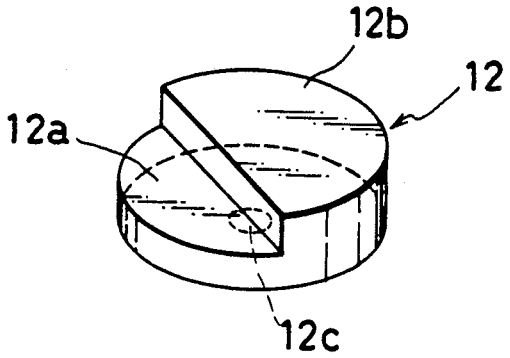
FIG. 2 is a schematic drawing showing a perspective view of a stopper.

FIG. 2 is a schematic drawing showing a perspective view of the stopper 12. As shown in FIG. 2, the stopper 12 is formed by cutting a cylindrical member along a plane parallel to its axis so that a bottom portion remains and comprises a bottom portion 12a and a projection portion 12b. The stopper 12 is disposed so that the upper face of the bottom portion 12a is positioned on the same plane as the upper face of the coin sorting passage 8. Further, the stopper 12 is normally disposed so that only the bottom portion 12a is positioned within the coin sorting passage 8 and that a plane of the projection portion 12b parallel to the axis is positioned on the same plane as the side face of the guide plate 7 facing the guide plate 6. In the case where the control system detects a counterfeit coin or an uncurrent coin based upon an input signal from the sensor 10, the stopper 12 is rotated about a shaft 12c by a stopper drive means (not shown) and the projection portion 12b moves into the coin sorting passage 8, whereby the counterfeit coin or the uncurrent coin is prevented from being fed to the coin stacking section by the stopper 12. The control system drives a first drive means (not shown) to stop the rotation of the rotatable disk 1 and the movement of the transporting belt in synchronism with the rotation of the stopper 12 and then rotates the rotatable disk 1 and moves the transporting belt in the reverse direction, thereby to return the counterfeit coin or the uncurrent coin prevented from being fed by the stopper 12 and the following coins onto the rotatable disk 1.

Further, in the case where the control system judges based upon the input signal from the sensor 10 that a predetermined number of coins have been fed to the coin stacking section, the control system drives the stopper drive means to rotate the stopper 12 and drives the first drive means to stop the rotation of the rotatable disk 1 and the movement of the transporting belt. After a predetermined time has passed, the control system drives the stopper drive means again to reversely rotate the stopper 12 and return the stopper 12 to the normal position and at the same time, drives the first drive means to rotate the rotatable disk 1 and move the transporting belt again. As a result, transport of the coins from the rotatable disk 1 via the coin sorting passage 8 to the coin stacking section is restarted.

Above the coin passage between the opening 3 of the annular guide 2 and the coin sorting apparatus 5, a double feed preventing member 20 is provided and the space between the upper face of the coin passage 4 and itself is adjustable. Further, in the vicinity of an upstream end of the guide plate 6, a rotatable guide roller 21 is provided for smoothly feeding the coins from the rotatable disk 1 to the coin sorting apparatus 5 and on the coin passage 4 on the side of the guide plate 7, a guide member 22 is provided for guiding the coins moving within the coin passage 4. The guide roller 21 is movable together with the guide plate 6 and the guide member 22 is movable together with the guide plate 7 widthwise relative to the coin sorting passage 8 respectively. The space between the double feed preventing member 20 and the upper face of the coin passage 4 is set by a second space adjusting means (not shown) so as to be greater than the thickness of the thickest coins to be handled and smaller than the double thickness of the thinnest coins to be handled for enabling all coins deposited into the coin handling machine to be feed into the coin sorting passage 8 one by one.

Since in the case where the sensor 10 does not detect any coin for a predetermined time period, while some coins are present on the rotatable disk 1, it is considered that coin jamming has occurred between the rotatable disk 1 and the sensor 10. An electrostatic microphone 30 is secured to the circumference of the annular guide 2 for detecting such coin jamming. More specifically, the electrostatic microphone 30 detects vibration produced by collision between the coins present on the rotatable disk 1 and the annular guide 2 and outputs a detection signal to the control system, whereby the control system can judge whether or not some coins are present on the disk 1.

In the thus constituted coin handling machine, coins deposited into the coin handling machine are fed via the rotatable disk 1 and the coin passage 4 to the coin sorting passage 8 where all the coins other than those of the largest diameter fall into the coin collecting opening 9, thereby to be collected and only the coins of the largest diameter are fed every predetermined number thereof to the coin stacking section where they are stacked and are further fed to the coin wrapping section where they are wrapped in a roll form. In the case where the control system detects based upon the input signals from the sensor 10 and the electrostatic microphone 30 that some coins are present on the rotatable disk 1, while the sensor 10 does not detect any coin for the predetermined time period, and that coin jamming has occurred, the control unit outputs a jamming signal to the first drive means and, as a result, the first drive means drives the rotatable disk 1 and the transporting belt in the reverse direction and after a predetermined time has passed, drives the rotatable disk 1 and the transporting belt in the normal direction again, thereby to eliminate the coin jamming.

However, in cases where coins deposited into the coin handling machine erroneously contain those not expected to be handled, counterfeit coins or uncurrent coins for some reason, if the thickness of the erroneously deposited coins is greater than the space between the double feed preventing member 20 and the upper face of the coin passage 4, they remain on the rotatable disk 1 without being fed to the coin sorting apparatus 5 and if the thickness thereof is smaller than the space between the double feed preventing member 20 and the upper face of the coin passage 4, although they can pass through the double feed preventing member 20, if the diameter thereof is greater than the space between the pair of guide plates 6, 7, they cannot be fed into the coin sorting passage 8 and are returned onto the rotatable disk 1 by force produced by the rotation of the rotatable disk 1, where they remain, and the erroneously deposited counterfeit coins or uncurrent coins are detected by the sensor 10 and returned to the rotatable disk 1, even if the thickness thereof is smaller than the space between the double feed preventing member 20 and the upper face of the coin passage 4 and the diameter thereof is smaller than the space between the pair of the guide plates 6, 7. As a result, in these cases, some coins can remain on the rotatable disk 1. In the prior art machines, it is impossible to remove the thus remaining coins from the rotatable disk 1 unless the space between the double feed preventing member 20 and the upper face of the coin passage 4 and/or the space between the pair of guide plates 6, 7 is reset to be greater for collecting the coins via the coin collecting opening 9 or the coin stacking section, or unless the coin handling machine is opened for removing them manually. However, in this embodiment, a coin removing apparatus 40 is further provided in the opening 3 of the annular guide 2 in the vicinity of the circumference of the rotatable disk 1 on the side of the electrostatic microphone 30 for removing the coins remaining on the rotatable disk 1 and, therefore, it is possible to easily remove the coins remaining on the rotatable disk 1.

Figure 3:
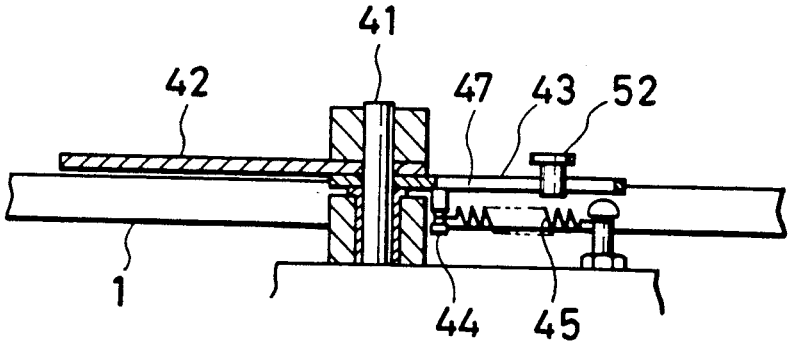
FIG. 3 is a schematic drawing showing a crosssectional view taken on line A—A of FIG. 1.

FIG. 3 is a schematic drawing showing a crosssectional view taken on line A—A of FIG. 1.

Referring to FIGS. 1 and 3, the coin removing apparatus 40 comprises a coin removing lever 42 swingably mounted on a shaft 41 extending vertically, the side face of the coin removing lever 42 on the side of the rotatable disk 1 being formed arcuate so as to have the same shape as the circumference of the rotatable disk 1 and the opposite face being formed planer, and a swing member 43 fixed to the coin removing member 42 in the vicinity of an end portion thereof which is mounted on the shaft 41 and swingably mounted on the shaft 41. The swing member 43 is biased counterclockwise about the shaft 41 in FIG. 1 by a tension spring 45, one end of the tension spring 45 being secured to a body of the coin handling machine and the other end thereof being secured to a pin 44 formed on the bottom face of the swing member 43. Accordingly, although the coin removing lever 42 is also biased counterclockwise in FIG. 1, since a stopper pin 46 is provided for controlling the position of the coin removing lever 42, the coin removing lever 42 is normally positioned at a retracted position indicated by a solid line in FIG. 1 in the vicinity of outside of the circumference of the rotatable disk 1 so that the side face thereof on the side of the rotatable disk 1 is formed to be extension plane of the inner face of the annular guide 2. The swing member 43 is formed with a groove 47 extending in the longitudinal direction thereof and an arm member 51 is fixed to a rotatable shaft 50 of a coin removing motor (not shown) at one end thereof, the other end of the arm member 51 being formed with a pin 52 engaged with the groove 47.

On the outside of the coin removing lever 42, a remaining coin collecting opening 60 is formed for collecting the coins removed by the coin removing lever 42 from the rotatable disk 1.

Figure 4:
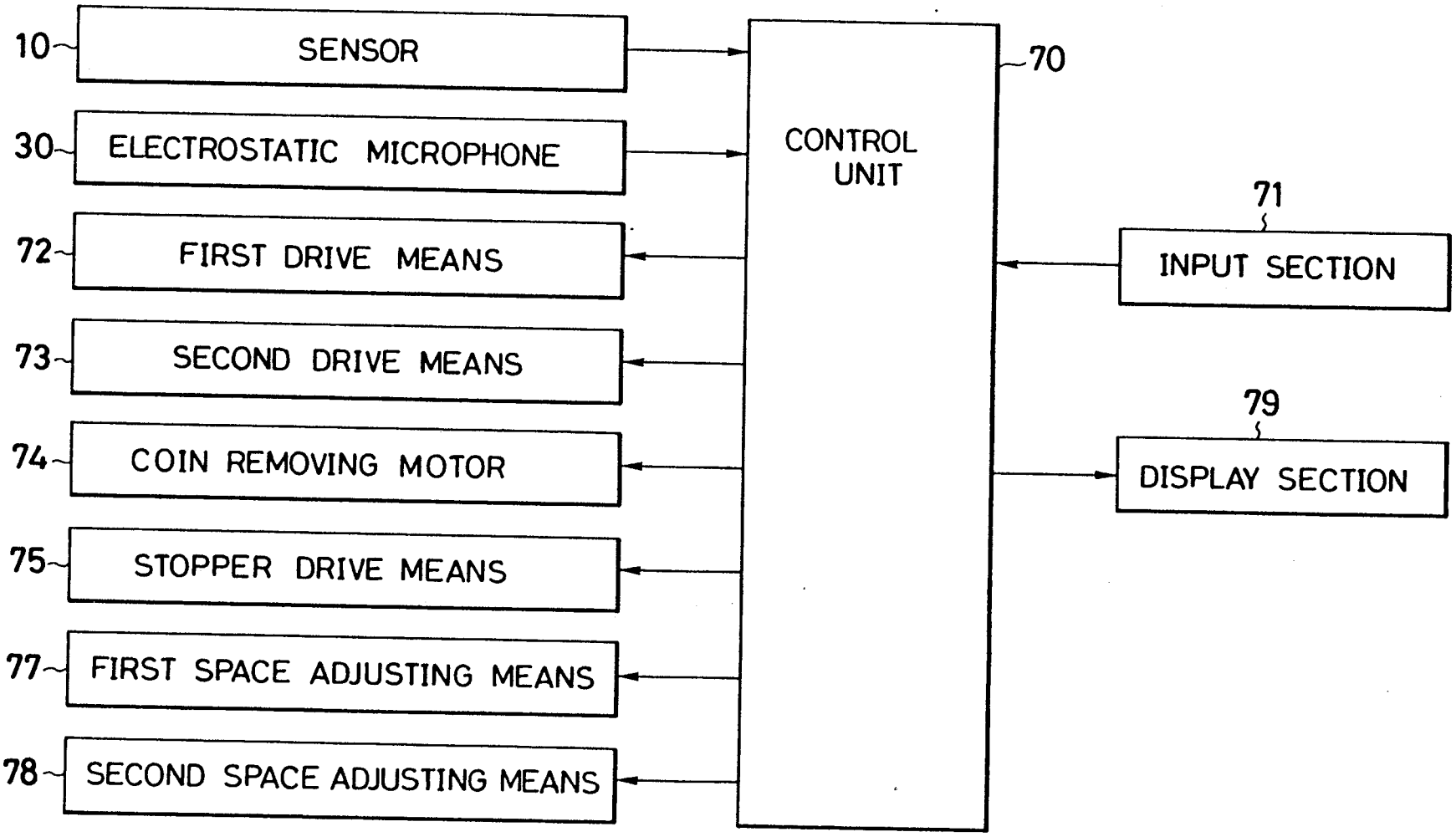
FIG. 4 is a block diagram showing input, detection, control, drive and output systems of a coin removing apparatus which is an embodiment of the present invention.

FIG. 4 is a block diagram showing input, detection, control, drive and output systems of the coin removing apparatus which is an embodiment of the present invention.

Referring to FIG. 4, the detection signals detected by the sensor 10 and the detection signals detected by the electrostatic microphone 30 are respectively input to the control unit 70 and input signals input by the operator from an input section 71 are input to the control unit 70. On the other hand, the control unit 70 outputs drive signals to the first drive means 72, a second drive means 73 for moving the transporting belt, the coin removing motor 74, the stopper drive means 75, the first space adjusting means 77 and the second space adjusting means 78 respectively and further outputs display signals to a display section 79.

In the thus constituted coin removing apparatus for the coin handling machine which is an embodiment of the present invention, at first, denominations of coins to be handled by the coin handling machine are input to the input section 71 by the operator and a denomination signal is input to the control unit 70 from the input section 71. The control unit 70 stores the denomination signal in a RAM (not shown) thereof. At the same time, the control unit 70 reads out, based upon the denomination signal, a set value for setting the space between the pair of guide plates 6, 7, the set value being determined in advance in accordance with the largest diameter coins to be handled and stored in a ROM (not shown) thereof and a set value for setting the space between the double feed preventing member 20 and the upper face of the coin passage 4, the set value being determined in advance in accordance with the thickest coins to be handled and stored in the ROM. The ROM respectively outputs these values to the first space adjusting means 77 and the second space adjusting means 78, thereby to adjust the space between the pair of guide plates 6, 7 and the space between the double feed preventing means and the upper face of the coin passage 4 to be predetermined values.

Afterward, when coins have been deposited into the coin handling machine and a start signal has been input via the input section 71 to the control unit 70, the control unit 70 drives the second drive means 73 for enabling the coin feed belt (not shown) to move, thereby to feed the deposited coins onto the rotatable disk 1 and synchronously drives the first drive means to rotate the rotatable disk 1 and move the transporting belt. As a result, the coins fed onto the rotatable disk 1 are fed along the inner face of the annular guide 2 to the coin passage 4 via the opening 3 of the annular guide 2 by centrifugal force produced by the rotation of the rotatable disk 1. Then, the coins are separated one by one by the double feed preventing member 20 and fed to the coin sorting passage 8 formed between the pair of guide plates 6, 7 of the coin sorting apparatus 5, while being guided by the guide roller 21 and the guide member 22. Since the space between the double feed preventing member 20 and the upper face of the coin passage 4 is set by the second space adjusting means 78 to be greater than the thickness of the thickest coins to be handled and smaller than the double thickness of the thin-nest coins to be handled, and the space between the pair of guide plates 6, 7 is set by the first space adjusting means 77 to be larger than that of the largest coins to be handled, all the coins deposited into the coin handling machine are normally fed one by one into the coin sorting passage 8. Further, since the space between the guide rails **6*a*, 7*a* is set by the first space adjusting means 77 so that only the largest diameter coins to be handled are supported thereby and transported in the coin sorting passage 8, all the coins other than the largest diameter coins fall into the coin collecting opening 9** and are collected by the coin collecting means (not shown).

Then, the sensor 10 discriminates the genuineness of the coins which did not fall into the coin collecting opening 9 and have been transported in the coin sorting passage 8, counts the number thereof and outputs the detection signals to the control unit 70. The genuine coins passed by the sensor 10 are further fed to the coin stacking section (not shown). In the case where counterfeit coins or uncurrent coins are not detected by the sensor 10, when the control unit 70 judges that a predetermined number of coins have been fed to the coin stacking section, it outputs the drive signal to the stopper drive means 75 and the stopper drive means 75 rotates the stopper 12 about the rotatable shaft **12*c* so as to position the projection portion 12*b* in the coin sorting passage 8, thereby to prevent the following coins from being fed to the coin stacking section. At the same time, the control unit 70 outputs a drive stop signal to the first drive means 72, thereby to stop the rotation of the rotatable disk 1** and the movement of the transporting belt.

After a predetermined time has passed and when the coins stacked in the coin stacking section have been fed to the coin wrapping section (not shown), the control unit 70 outputs a drive release signal to the stopper drive means 75 so that the stopper 12 is rotated about the rotatable shaft **12*c* in the reverse direction and is returned to its retracted position and outputs the drive signal to the first drive means 72, thereby to rotate the rotatable disk 1** and move the transporting belt again.

Thus, when all the largest diameter coins have been wrapped, the control unit 70 outputs a wrapping completion signal to the display section 79 to display the information that the wrapping operation has been completed.

Afterward, if necessary, the coins collected by the coin collecting means (not shown) via the coin collecting opening 9 are deposited into the coin handling machine through the coin deposit opening (not shown) again and the largest diameter coins deposited are sorted from the other denominations of coins, stacked in the coin stacking section and further wrapped in a roll form in the coin wrapping section. Similar operation is repeated as occasion demands.

On the contrary, in the case where the control unit 70 judges based upon the input signal from the sensor 10 that counterfeit coins or uncurrent coins have passed by the sensor 10, it outputs the drive signal to the stopper drive means 75 so that the stopper 12 is rotated about the rotatable shaft **12*c* so as to position the projection portion 12*b* in the coin sorting passage 8, thereby to prevent the counterfeit coins or the uncurrent coins and the following coins from being further transported. Simultaneously, the control unit 70 outputs the drive stop signal to the first drive means 72, thereby to stop the rotation of the rotatable disk 1 and the movement of the transporting belt. Then, the control unit 70 outputs a reverse drive signal to the first drive means 72, thereby to rotate the rotatable disk 1 in the reverse direction and move the transporting belt in the reverse direction so that the counterfeit coins or the uncurrent coins and the following coins are returned onto the rotatable disk 1. After the the counterfeit coins or the uncurrent coins and the following coins have been returned onto the rotatable disk 1, the control unit 70 outputs the drive signal to the first drive means 72** for enabling it to restart the coin handling operation.

Further, in the case where no signal has been input from the sensor 10 for a predetermined time period to the control unit 70, while the coin detection signal is being input from the electrostatic microphone 30 thereto, the control unit 70 judges that the coins are jammed between the rotatable disk 1 and the sensor 10 and continues to output the reverse drive signal to the first drive means 72 for a predetermined time period, thereby to rotate the rotatable disk 1 and move the transporting belt in the reverse direction. Then, the control unit 70 outputs the drive signal to the first drive means 72, thereby to rotate the rotatable disk 1 and move the transporting belt in the normal direction. As a result, if the control unit 70 receives the detection signal again from the sensor 10, it judges that the coin jamming has been eliminated and continues the coin handling operation.

On the contrary, in cases where coins not expected to be deposited, counterfeit coins or uncurrent coins are erroneously contained among the coins deposited into the coin handling machine for some reason, it is possible that even though the coin detection signal is being input from the electrostatic microphone 30, even if the above unjamming operation is conducted, no signal is input from the sensor 10 to the control unit 70 and the coin jamming cannot be eliminated. More specifically, in the case where the thickness of the erroneously deposited coins is greater than the space between the double feed preventing member 20 and the upper face of the coin passage 4, the coins cannot be fed into the coin sorting apparatus 5 and remain on the rotatable disk 1, and even though the erroneously deposited coins can pass by the double feed preventing member 20 since the thickness thereof is smaller than the space between the double feed preventing member 20 and the upper face of the coin passage 4, in the case where the diameter thereof is larger than the space between the pair of guide plates 6, 7, the coins cannot be fed into the coin sorting passage 8 but are returned onto the rotatable disk 1 by force produced by the rotation of the rotatable disk 1 and remain on the rotatable disk 1. As a result, although the electrostatic microphone 30 detects some coins on the rotatable disk 1, no coin is fed to the sensor 10 and this situation cannot be eliminated by the above stated unjamming operation. Therefore, in this embodiment, in the case where no signal is input from the sensor 10 to the control unit 70 even though a predetermined time has passed after the above unjamming operation was completed, while the coin detection signal is being input from the electrostatic microphone 30 thereto, the control unit 70 outputs a drive signal to the coin removing motor 74 so as to rotate the rotatable shaft 50 clockwise in FIG. 1 and outputs the reverse drive signal to the first drive means 72 so as to rotate the rotatable disk 1 in the reverse direction. When the rotatable shaft 50 is rotated clockwise in FIG. 1, the arm member 51 swings clockwise, whereby the pin 52 formed at the tip end portion of the arm member 51 and engaged with the groove 47 of the swing member 43 moves toward the end opposite to the shaft 41 and clockwise in the groove 47 of the swing member 43. Accordingly, the swing member 43 swings clockwise about the shaft 41 against the biasing force of the tension spring 45, whereby the coin removing lever 42 fixed to the swing member 43 swings clockwise about the shaft 41 and moves from the retracted position indicated by a solid line in FIG. 1 to the projecting position indicated by a broken line in FIG. 1. On the other hand, since the rotatable disk 1 is rotated counterclockwise in FIG. 1, the coins remaining on the rotatable disk 1 move counterclockwise along the inner face of the annular guide 2 and are caught by the flat side face of the coin removing lever 42 positioned at the projecting position. In this manner, if the rotatable shaft 50 of the coin removing motor 74 is further rotated clockwise, the pin 52 formed at the tip end portion of the arm member 51 moves in the opposite direction to that at the initial stage, that is, toward the shaft 41 in the groove 47 of the swing member 43, whereby the swing member 43 swings counterclockwise about the shaft 41. As a consequence, the coin removing lever 42 which has moved from the retracted position to the projecting position starts swinging counterclockwise about the shaft 41 from its projecting position and at the time when the rotatable shaft 50 has been rotated by one revolution, the swing member 43 has been returned to the position indicated by a solid line in FIG. 1 and the coin removing lever 42 also has been returned to its retracted position. Therefore, the coin removing lever 42 at first swings clockwise in FIG. 1 to move from its retracted position to its projecting position and then swings counterclockwise to move from its projecting position to its retracted position during one revolution of the rotatable shaft 50 of the coin removing motor 74. Thus, when the rotatable shaft 50 of the coin removing motor 74 has been rotated by one revolution, the control unit 70 outputs the drive stop signal to the first drive means 72, thereby to stop the rotation of the rotatable disk 1. As a result, the remaining coins caught by the coin removing lever 42 positioned at the projecting position are collected in the remaining coin collecting opening 60, while being guided by the flat side face of the coin removing lever 42 in accordance with the movement of the coin removing lever 42 from its projecting position to its retracted position.

Further, in the case where the thickness of counterfeit coins or uncurrent coins erroneously deposited into the coin handling machine is smaller than the space between the double feed preventing member 20 and the upper face of the coin passage 4 and the diameter thereof is smaller than the space between the pair of guide plates 6, 7, these coins are detected by the sensor 10, prevented from being fed to the coin stacking section by the stopper 12 and returned onto the rotatable disk 1. Therefore, since the control unit 70 receives only detection signals showing that counterfeit coins or uncurrent coins were detected by the sensor 10 for a predetermined time period, it judges that only counterfeit coins or uncurrent coins remain on the rotatable disk 1 and the counterfeit coins or the uncurrent coins remaining on the rotatable disk 1 are collected in the remaining coin collecting opening 60 by the coin removing lever 42 in the same manner as described above in connection with removing the remaining coins.

According to the above described embodiment, in the case where coins not expected to be handled, counterfeit coins or uncurrent coins are erroneously deposited into the coin handling machine and cannot be fed to the coin sorting apparatus but remain on the rotatable disk 1 because their thickness is greater than the space between the double feed preventing member 20 and the upper face of the coin passage 4, or in the case where such erroneously deposited coins can pass by the double feed preventing member 20 because their thickness is smaller than the space between the double feed preventing member 20 and the upper face of the coin passage 4 but cannot be fed into the coin sorting passage 8 because their diameter is larger than the space between the pair of guide plates 6, 7, so that they are returned by force produced by the rotation of the rotatable disk 1 onto the rotatable disk 1 where they remain, it is possible to easily remove the coins remaining on the rotatable disk 1 from the coin handling machine without opening the coin handling machine and there is no risk of unnecessary unjamming operation being repeated.

As described above with reference to the preferred embodiment, it is possible to provide a coin removing apparatus for a coin handling machine capable of easily removing coins remaining in the coin handling machine and eliminating unnecessary repetition of unjamming operation.

The present invention has thus been shown and described with reference to a specific embodiment. However, it should be noted that the present invention in no way limited to the details of the described arrangements but changes and modifications may be made without departing from the scope of the appended claims.

For example, in the above described embodiment, although the unjamming operation is conducted by rotating the rotatable disk 1 and moving the transporting belt in the reverse direction and then rotating the rotatable disk 1 and the transporting belt in the normal direction, the unjamming operations may be conducted by repeating these operation by two or more times.

Further, in the above described embodiment, although the pair of movable guide plates 6, 7 are employed, a fixed guide plate and a movable guide plate may be employed and the space between them may be adjusted by moving the movable guide plate.

Furthermore, in the above described embodiment, although the guide rails 6*a*, 7*a* are secured to the bottom face of the pair of guide plates 6, 7 for supporting the edges of the largest diameter coins to be handled and determining the width of the coin collecting opening 9, plate-like portions may be integrally formed in the vicinity of the bottoms of the pair of guide plates 6, 7 so as to face each other in place of the guide rails 6*a*, 7*a*.

Moreover, in the above described embodiment, although the coins remaining on the rotatable disk 1 are removed by reversely rotating the rotatable disk 1 and swinging the coin removing lever 42 clockwise to be moved from its retracted position to its projecting position and further swinging it counterclockwise to be moved from its projecting position to its retracted position, the remaining coins may be removed by arranging the remaining coin collecting opening on the opposite side to the arrangement shown in FIG. 1 with respect to the coin removing apparatus 40, rotating the rotatable disk 1 in the normal direction, swinging the coin removing lever 42 counterclockwise to be moved from its retracted position to its projecting position and further swinging the coin removing lever 42 clockwise to be moved from its projecting position to its retracted position.

Further, the mechanism for moving the coin removing lever 42 between its retracted position and its projecting position is not limited to that employed in the above described embodiment and any of various other mechanisms may be employed instead. For example, the rotatable shaft 50 of the coin removing motor 74 may be directly connected to the shaft 41 of the coin removing lever 42 and it is possible to move the coin removing lever 42 from its retracted position to its projecting position by driving the coin removing motor 74 and after a predetermined time has passed, to move it from its projecting position to its retracted position by driving the coin removing motor 74 in such a manner that the rotatable shaft 50 is reversely rotated. Further, such movement of the coin removing lever 42 may be carried out by use of a solenoid.

Moreover, in the above described embodiment, although the electrostatic microphone 30 is employed as a means for detecting the presence of coins on the rotatable disk 1, other means can be employed for this purpose and in addition to the electrostatic microphone 30, there may be provided a lever swingable about a shaft, the space between the tip end thereof and the rotatable disk 1 being adjustable, for detecting the number of coins remaining on the rotatable disk 1 by setting the space between its tip end and the rotatable disk 1 to be slightly larger than the thickness of the thickest coins to be handled and detecting an amount of swing of the lever about the shaft.

Further, in the above described embodiment, although the stopper 12 is formed by cutting a part of the cylindrical member along the plane parallel to its shaft and is driven by the stopper drive means 75, it is possible to form the stopper by cutting a part of an actuating bar of a rotary solenoid so that the stopper and a drive means therefor are integrally formed.

We claim:

1. A coin removing apparatus for a coin handling machine comprising a rotatable disk for receiving deposited coins, annular guide means provided on the periphery of said rotatable disk and formed with an opening, coin sorting means for sorting the coins in accordance with their denominations, double feed preventing means disposed above a coin passage between said coin sorting means and said opening of the annular guide means, a space between said double feed preventing means and said coin passage being adjustable, coin transporting means provided in said coin sorting means for transporting the coins, sensor means provided in said coin sorting means for detecting the coins, coin detection means for detecting presence of coins on said rotatable disk and coin jamming eliminating means for conducting unjamming operation by rotating said rotatable disk and driving said coin transporting means in a reverse direction and then rotating said rotatable disk and driving said coin transporting means in a normal direction, and repeating such operation a predetermined number of times in a case where said coin detection means detect coins on said rotatable disk after a predetermined time has passed since said sensor means detected a last coin, said coin removing apparatus comprising movable lever coin diverting means for removing the coins on said rotatable disk and control means for driving said coin diverting means to remove the coins from said rotatable disk, in the case where said sensor means does not detect any coins and said coin detection means detects some coins after a predetermined time has passed since the unjamming operation was completed.

2. A coin removing apparatus for a coin handling machine in accordance with claim 1 wherein said coin diverting means comprises a lever which is swingable about a shaft and projects onto said rotatable disk when said coin diverting means is driven by said control means, a side face of said lever being formed arcuately so that it has the same shape as a circumference of said rotatable disk, and when said coin diverting means is driven by said control means, said lever swings in an opposite direction to that of rotation of the rotatable disk so that the side opposite said side face of the lever can catch the coins remaining on said rotatable disk and remove them.

3. A coin removing apparatus for a coin handling machine in accordance with claim 2 which further includes a remaining coin collecting opening on the side of said lever of the coin removing means and in the vicinity of the circumference of said rotatable disk.

* * * * *